US005441449A

United States Patent [19]

Hart

[11] Patent Number: 5,441,449

[45] Date of Patent: Aug. 15, 1995

[54] INTEGRATABLE GRINDING WHEEL DRESSER

[76] Inventor: Glen B. Hart, 22031 S. Kamrath Rd., Beaver Creek, Oreg. 97004

[21] Appl. No.: 261,845

[22] Filed: Jun. 16, 1994

[51] Int. Cl.[6] ..... B24B 9/00

[52] U.S. Cl. ..... 451/72; 125/11.01

[58] Field of Search ..... 451/72, 56; 125/11.01, 125/11.14, 11.18

[56] References Cited

U.S. PATENT DOCUMENTS

| | | | |
|---|---|---|---|
| 1,553,524 | 8/1922 | Erdman | 125/11.01 |
| 2,171,516 | 9/1939 | Alvord . | |
| 2,276,260 | 3/1942 | Turrettini . | |
| 2,282,038 | 5/1942 | Davenport . | |
| 2,326,073 | 8/1943 | Seyferth . | |
| 2,351,159 | 6/1994 | Stewart . | |
| 2,463,126 | 3/1949 | Sneva . | |
| 2,647,504 | 8/1953 | Hill . | |
| 2,658,496 | 11/1953 | Hoglund . | |
| 2,658,501 | 11/1953 | Hoglund . | |
| 3,221,727 | 5/1963 | Pitcl et al. | 125/11.01 |
| 3,372,687 | 3/1968 | Grabowski . | |
| 3,455,289 | 7/1969 | Hoglund . | |
| 4,163,346 | 8/1979 | Matson | 125/11.01 |

FOREIGN PATENT DOCUMENTS

| | | | |
|---|---|---|---|
| 3838517 | 8/1989 | Germany | 125/11.01 |
| 0278764 | 11/1988 | Japan | 125/11.01 |
| 0901835 | 7/1962 | United Kingdom | 125/11.01 |
| 2116085 | 9/1983 | United Kingdom | 125/11.01 |

*Primary Examiner*—Bruce M. Kisliuk
*Assistant Examiner*—Derris Banks
*Attorney, Agent, or Firm*—William A. Birdwell & Associates

[57] ABSTRACT

A grinding wheel dresser, integratable with a grinding apparatus and useable to repeatedly dress the face of a grinding wheel to a selected contour in alternation with use of the grinding wheel, the dresser having a dressing mechanism, a dressing control mechanism coupled to the dressing mechanism to control the dressing mechanism in dressing the face of the grinding wheel, and an integration mechanism coupled to the dressing mechanism to provide for integration of the grinding wheel dresser with the grinding apparatus. The dressing control mechanism preferably includes a template mechanism providing information representative of the selected contour to which the face of the grinding wheel is to be dressed; a translation mechanism translating the template's information into displacements of the dressing mechanism; and an actuation mechanism, coupled to the translation mechanism, actuating the displacements. The grinding wheel dresser preferably includes an adjustment mechanism coupled to the dressing mechanism that provides for adjustment of the dressing mechanism's alignment.

25 Claims, 5 Drawing Sheets

INTEGRATABLE GRINDING WHEEL DRESSER

BACKGROUND OF THE INVENTION

This invention relates to grinding wheel dressers, particularly to grinding wheel dressers integratable with a grinding apparatus having a grinding wheel.

Grinding apparatuses are widely used and enjoy a great variety of applications. One application is in the sharpening of saw blades used in sawmills. That application, like many others, is characterized by the concurrent needs for both high production and high precision. The saw blades are continuous bands, approximately 32 feet in length and about eleven inches high, and generally are formed from saw-grade steel. In sharpening the cutting surface of the blade, e.g. the gullets and lands of the band's multitudinous teeth, saw-sharpening machines typically are used, wherein the blade is disposed in a horizontal plane so that the cutting surface is vertically directed and the blade is rotationally cycled through a grinding apparatus. As the blade is cycled through the machine, the grinding apparatus is driven into the gullets and over the lands of each tooth.

Typically, the sharpening machine's grinding wheel is dressed by hand. Dressing by hand requires that the grinding wheel be disengaged from the saw blade, that is, sharpening of the saw blade cannot be continued while dressing the wheel, thereby impeding productivity. In addition, dressing by hand, even when performed by an expert, achieves less than desirable precision which, together with the volume of grinding, requires the wheel to be dressed and redressed during the sharpening of each saw blade.

Grinding wheel dressing devices generally have not been employed in this application, because to do so has also required that the sharpening process be halted for undesirably long periods. Conventional dressing devices have not been employed, particularly because they are not adapted for dressing the grinding wheel in selectable alternation with use of the grinding wheel to sharpen the blade. That is, conventional dressing devices are subject to undesirable limitations, including that they generally must be installed and uninstalled for each dressing operation, if installable at all, and if not installable the grinding wheel must be removed from the grinding apparatus and brought to the dressing device at a remote location. Thence, conventional dressing devices, when useable, can introduce undesireably long delays and, even so, generally require substantial alignment in each case to achieve high precision dressing of the grinding wheel. These problems result, in part, because conventional dressing devices tend to be bulky and heavy, or must be installed in a location that precludes use of the grinding apparatus, such as on a table or platform disposed between the grinding apparatus and the user, or both. Conventional dressing apparatuses can be found in Stewart U.S. Pat. No. 2,351,158 and Grabowski U.S. Pat. No. 3,372,687.

The foregoing limitations of conventional dressing devices are not intended to be exhaustive, but rather are only exemplary of those which tend to impair the effectiveness of these conventional devices. Nevertheless, the foregoing limitations are sufficient to demonstrate that conventional dressing devices are not altogether satisfactory.

Accordingly, there is a need for an improved grinding wheel dresser that overcomes these and other limitations of conventional dressing devices.

SUMMARY OF INVENTION

The present invention fulfills the aforementioned need by providing a grinding wheel dresser integratable with a grinding apparatus, useable to repeatedly dress the face of a grinding wheel to a selected contour in alternation with use of the wheel to grind. The grinding wheel dresser has a dressing mechanism, a dressing control mechanism coupled to the dressing mechanism, and an integration mechanism coupled to the dressing mechanism. The dressing control mechanism controls the dressing mechanism in dressing the face of the grinding wheel. The integration mechanism provides for integration of the grinding wheel dresser with the grinding apparatus.

The grinding wheel dresser preferably includes an adjustment mechanism coupled to the dressing mechanism that provides for adjustment of the alignment of the dressing mechanism along the radial and transverse axes of the grinding wheel. The adjustment is to finely align the dressing mechanism relative to the face, as the dimensions and geometries of the grinding wheel dresser are selected, according to the dimensions and geometries of the grinding apparatus and grinding wheel, so as to provide for substantial alignment upon integration.

In the grinding wheel dresser, the dressing control mechanism preferably includes a template mechanism, a translation mechanism and an actuation mechanism. The template mechanism provides information representative of the selected contour to which the face of the grinding wheel is to be dressed. The translation mechanism translates that information into displacements of the dressing mechanism along the radial and transverse axes of the grinding wheel. The actuation mechanism is coupled to the translation mechanism to actuate those displacements.

The template mechanism preferably comprises a cam having an outer periphery of predetermined shape, that shape being the information representative of the selected contour. In that case, the translation mechanism preferably comprises a cam follower and a biasing mechanism, the biasing mechanism biasing the cam follower to engage the cam.

The present invention also fulfills the aforementioned need by providing a method for repeatedly dressing the face of a grinding wheel to a selected contour in alternation with use of the wheel to grind. The method comprises the steps of integrating a grinding wheel dresser with the grinding apparatus, rotating the dressing mechanism of the grinding wheel dresser about a rotational axis associated with the grinding wheel dresser, and actuating displacements of the dressing mechanism along the radial and transverse axes of the grinding wheel, so as to selectably trim the face of the grinding wheel.

Accordingly, it is a principle object of the present invention to provide a novel and improved grinding wheel dresser.

It is another object of the present invention to provide a grinding wheel dresser integratable with a grinding apparatus.

It is a further object of the present invention to provide a grinding wheel dresser that provides for dressing of the grinding wheel in selectable alternation with use of the grinding wheel, including concurrent dressing and grinding, without un-installation and reinstallation of the dresser and while maintaining precision in each successive dressing.

It is yet another object of the present invention to provide a grinding wheel dresser that, upon integration with a grinding wheel, is substantially aligned for dressing.

It is yet a further object of the present invention to provide a grinding wheel dresser that has readily scalable dimensions and geometries so as to be integratable with the wide variety of grinding apparatuses, having a range of grinding wheel sizes and applications.

It is another object of the present invention to provide a grinding wheel dresser that accommodates economical, high production, high precision dressing of grinding wheels.

It is a further object of the present invention to provide a grinding wheel dresser that accommodates economical, high production, high precision dressing of grinding wheels based on the user's manual actuation of the grinding wheel dresser.

It is yet another object of the present invention to provide a grinding wheel dresser that is integratable by replacing the grinding apparatus' originally supplied guard.

It is yet a further object of the present invention to provide a grinding wheel dresser that employs a template mechanism, typically selectably interchangeable cams, each of predetermined shape, so as to provide information that represents and is translatable to dress the contour selected for the face of the grinding wheel.

It is another object of the, present invention to provide a grinding wheel dresser that can be used to dress the face, of a grinding wheel to a wide variety of shapes, including angular shapes, concave shapes and convex shapes, as well as combinations of one or more of these types of shapes.

It is a further object of the present invention to provide a method for integrating and using a grinding wheel dresser.

It is yet another object of the present invention to provide a grinding wheel dresser that is compact, durable and lightweight.

It is yet a further object of the present invention to provide a grinding wheel dresser that has economy of structure so as to be inexpensive to manufacture, while being easy to install and use.

The foregoing and other objects, features and advantages of the invention will be more readily understood upon consideration of the following detailed description of the invention, taken in conjunction with the accompanying drawings.

DETAILED DESCRIPTION OF THE INVENTION

Figure 1:
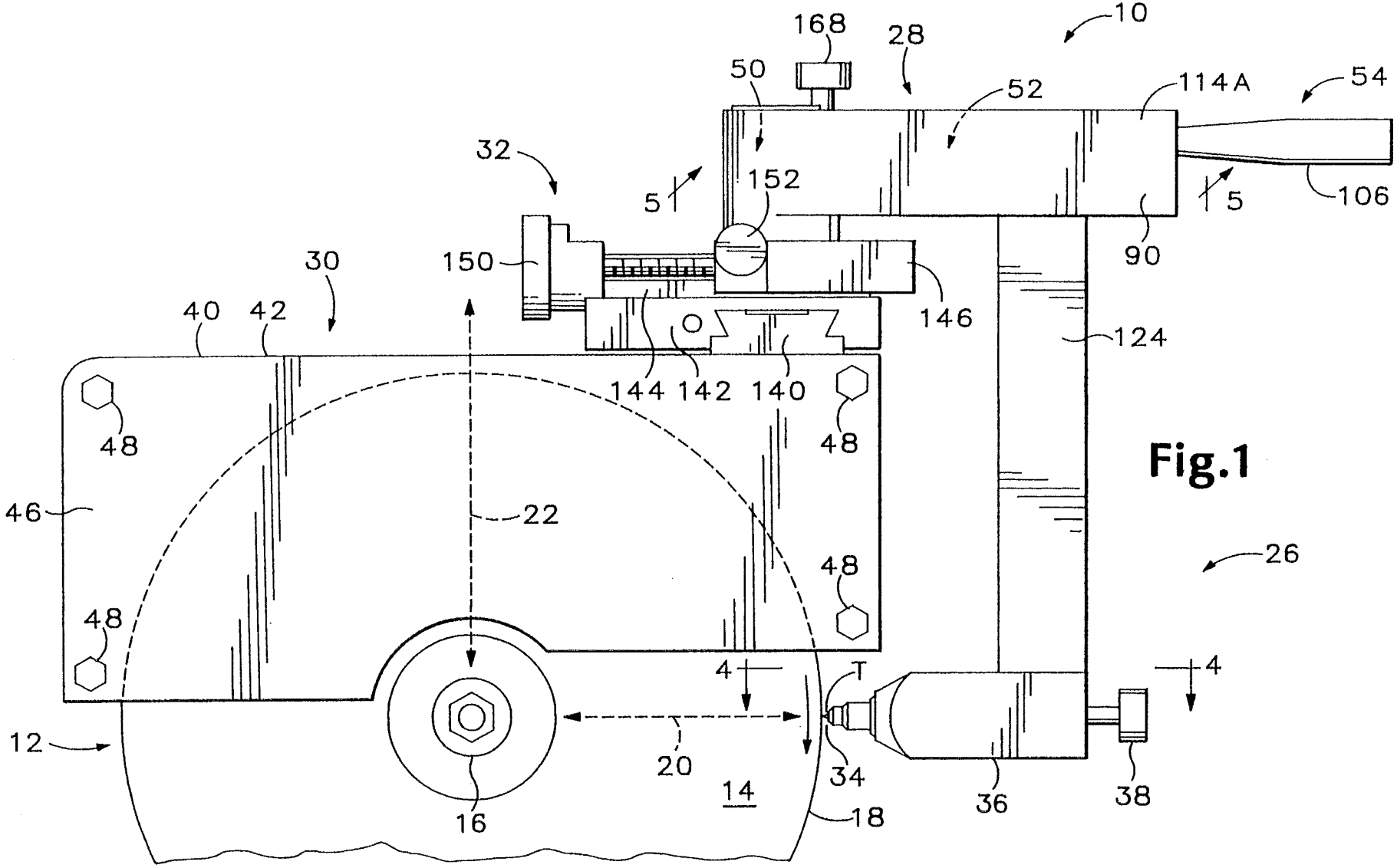
FIG. 1 is a first side view of an embodiment of a grinding wheel dresser in accordance with the present invention, the grinding wheel dresser integrated with a grinding apparatus having a grinding wheel.
Figure 2:
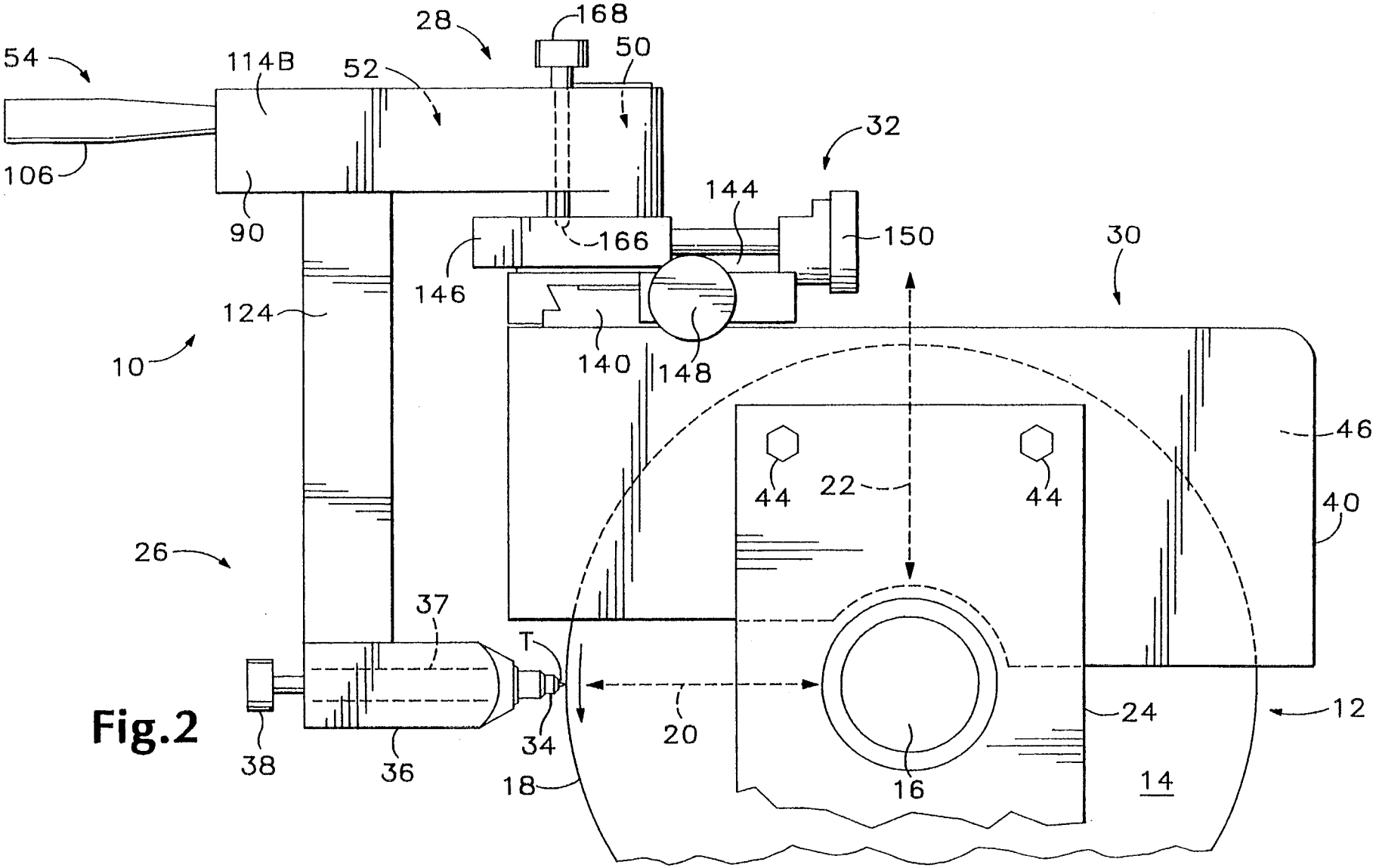
FIG. 2 is a second side view of the grinding wheel dresser of FIG. 1, the grinding wheel dresser integrated with a grinding apparatus having a grinding wheel.
Figure 3:
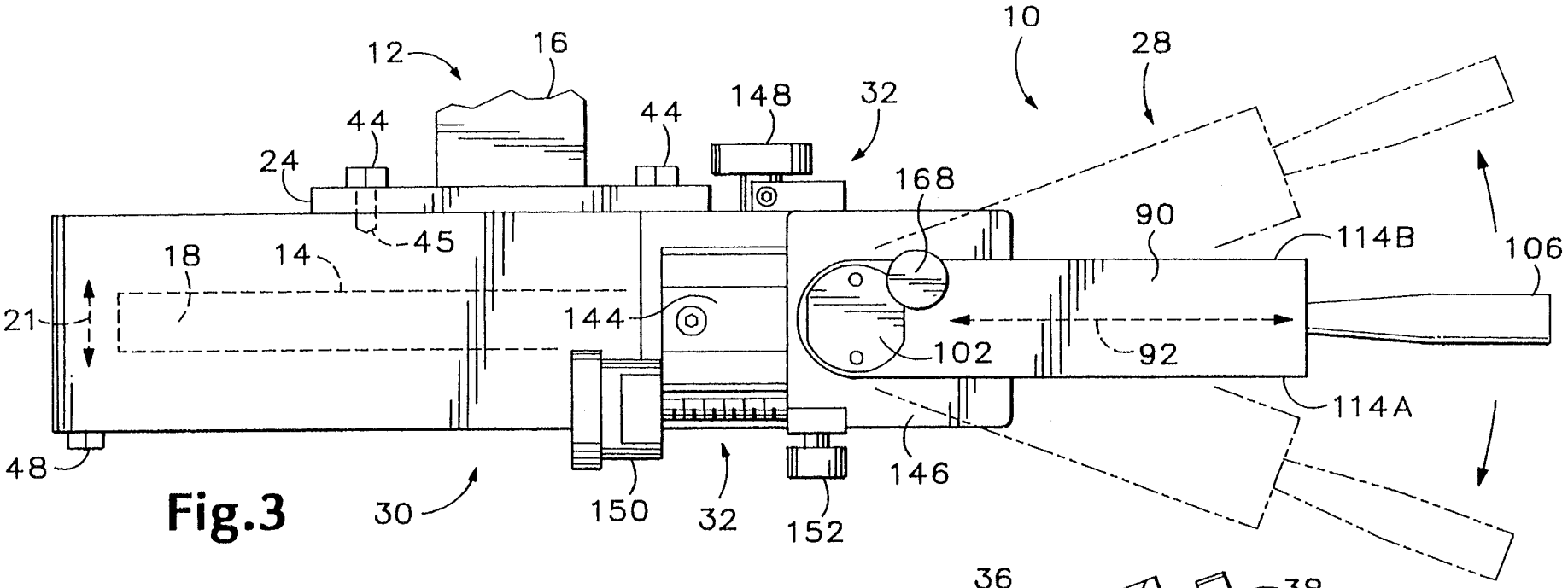
FIG. 3 is a top view of the grinding wheel dresser of FIG. 1, the grinding wheel dresser integrated with a grinding apparatus having a grinding wheel, the wheel shown in hidden lines.
Figure 4:
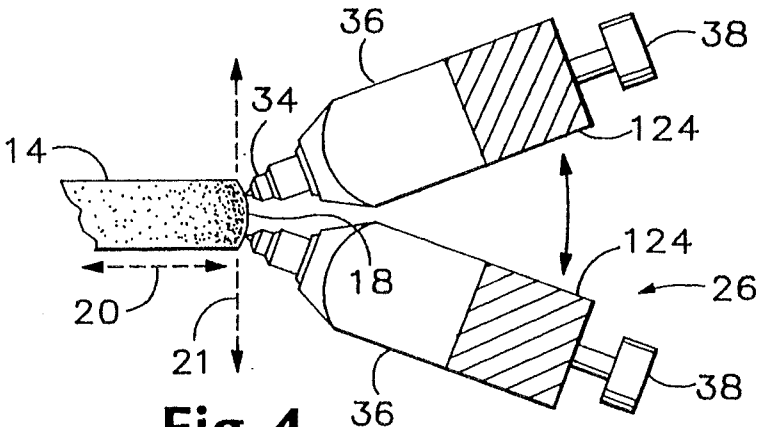
FIG. 4 is a partially cross-sectional, cut-away view of the grinding wheel dresser of FIG. 1, taken along line 4—4 thereof, showing a dressing mechanism engaging a grinding wheel at two rotational positions.

Referring to FIGS. 1–4, one embodiment of a grinding wheel dresser 10 is shown integrated with a grinding apparatus 12. The grinding apparatus 12 comprises a grinding wheel 14 rotatably mounted on an axle 16, the direction of the wheel's rotation being as indicated by arrows in FIGS. 1 and 2. The grinding wheel 14 comprises a face 18. The grinding wheel also comprises radial, transverse and elevational axes 20, 21 and 22. The radial axis 20 preferably lies along the substantially horizontal diameter of the wheel 14, as shown in FIGS. 1 and 2. As shown in FIGS. 3 and 4, the transverse axis 21 preferably is substantially perpendicular to the radial axis 20, and is substantially parallel to the rotational axis about which the grinding wheel rotates. As shown in FIGS. 1 and 2, the elevational axis 22 preferably lies along the substantially vertical diameter of the wheel 14, perpendicular to the radial axis 20. As is described below, the grinding wheel dresser 10 operates to trim, turn, shape and otherwise dress (hereafter referred to collectively by the term "dress") the face 18 of the grinding wheel 14 to a selected contour.

The grinding apparatus 12 further comprises a frame 24 which supports a guard (not shown) typically originally supplied with grinding apparatus 12 to fit over the grinding wheel 14 for safety purposes, including to catch flying debris generated by the wheel's grinding action. The frame 24, as shown, has a generally rectangular shape. This shape, however, is merely exemplary; it being recognized that the grinding wheel dresser 10 may be used in association with a frame 24 of other shape, without departing from the principles of the invention.

The grinding wheel dresser 10 comprises a dressing mechanism 26 for dressing the face 18 of the grinding wheel 14, a dressing control mechanism 28 coupled to and controlling the dressing mechanism 26, and an integration mechanism 30 to integrate the grinding wheel dresser 10 with the grinding apparatus 12. The grinding wheel dresser 10 preferably also comprises an adjustment mechanism 32, coupled to said dressing mechanism 26, for finely adjusting; alignment of the dressing mechanism 26 relative to the face 18 of the grinding wheel 14. As is described further below, the grinding wheel dresser 10 has selected dimensions and geometries so that, upon integration, the dressing mechanism 26 is substantially aligned relative to the face 18.

The dressing mechanism 26 preferably includes a dressing element 34 removably secured in an element mount 36. The dressing element 34 preferably comprises a dressing stylus having a diamond tip T, but it is to be recognized that the element 34 may comprise any appropriate dressing tool without departing from the principles of the invention. The element mount 36 has a bore 37 disposed therethrough, formed to precisely fit and hold the dressing element 34. When mounted in the element mount 36, the dressing element 34 is secured using a fastener 38 so that, in cooperation with the bore, the dressing element 34 is substantially precluded from moving relative to the element mount 36. The fastener 38, as shown, is a bolt; however, it is to be recognized that the fastener 38 may be other than a bolt without departing from the principles of the invention.

The integration mechanism 30 includes an integration member 40 attachable to the grinding apparatus 12 so as to integrate the grinding wheel dresser 10 with the grinding apparatus 12. The integration member 40 preferably is constructed of materials and has dimensions and geometries selected to provide substantially rigid integration, while providing an integration mechanism 30 that is relatively lightweight. Rigidity is important so as to reduce undesirable movement of the grinding wheel dresser 10, particularly of the dressing mechanism 26, and thereby maintain precise dressing. Lightweight is important so as to, for instance, reduce loading on the grinding apparatus 12, both when dressing and otherwise. In addition, the integration member 40 may provide for removable attachment of the grinding wheel dresser 10 to the grinding apparatus 12. It is to be recognized, however, that integration of the dresser 10 with the apparatus 12 may be permanent, without departing from the principles of the invention.

The integration member 40 preferably comprises a cover 42 attached to the grinding apparatus 12 at the frame 24. The cover 42, so attached, fits over the grinding wheel 14, generally replacing the guard originally supplied with the grinding apparatus 12. In order to provide for both rigidity and lightweight, it has been found that the cover 42 may be constructed of structural aluminum alloy plating having a thickness of approximately ¼-inch. In particular, aluminum alloy type 6061-T6 has been found acceptable, this alloy being commonly available by that designation and from a variety of sources. It is to be recognized, however, that other materials may be used without departing from the principles of the invention.

The cover 42 typically has, dimensions and geometries substantially matching the replaced guard of the grinding apparatus 12. That is, the cover 42 typically has a box-like shape with an open bottom so as to accommodate fitting over the grinding wheel 14 by insertion of the wheel 14 into the internal volume of the cover 42. It is to be recognized, however, that the cover 42 may have dimensions and geometries selectably different from those of the guard, in particular to provide increased rigidity or less weight, or both. For example, it is common practice in the art to honeycomb or otherwise trim metal plate at noncritical locations in order to reduce weight while maintaining the overall strength of the plate.

The cover 42, as shown, is removably attached to the frame 24 using fasteners 44 disposed through the frame 24. Although the fasteners 44, as shown, comprise bolts that thread into holes 45 disposed in the cover 42, it is to be recognized that other types of fasteners 44 may be used without departing from the principles of the invention. In addition, although the cover 42 is shown removably attached to the grinding apparatus 12 (for instance, to accommodate maintenance of the grinding wheel dresser 10 separate from the grinding apparatus 12), the cover 42 may be permanently attached to the grinding apparatus 12, such as by replacing fasteners 44 with rivets or welds, without departing from the principles of the invention.

The cover 42 preferably comprises a side wall 46 that is removably attached to the cover 42 using bolts 48. Removal of the side wall 46 provides for replacement of the grinding wheel 14, for instance when the wheel 14 is worn or damaged, and beyond dressing.

It is to be recognized that the integration member 40 may comprise structure other than the cover 42 and, in turn, the, grinding wheel dresser 10 may be integrated with the grinding apparatus 12 using grinding apparatus structure other than the frame 24, or both, without departing from the principles of the invention. For example, the integration member 40 may comprise a plate attached directly to the top of the guard originally provided with the grinding apparatus 12, provided that proper rigidity and weight are achieved as described above and that the grinding wheel dresser 10 may be constructed so as to substantially align upon integration or be adjustable for alignment, or both. The important point is that the integration member 40 provides for integrating the grinding wheel dresser 10 with the grinding apparatus 12, that is, it provides for dressing of the grinding wheel 14 in selectable alternation with use of the grinding wheel 14, without uninstallation and reinstallation of the dresser 10 and while maintaining precision in each successive dressing. Hereafter in this description and in the claims, "frame" is used to refer to any structure of the grinding apparatus 12 providing integrating attachment between the dresser 10 and the apparatus 12.

Referring to FIGS. 1–8, the dressing control mechanism 28 includes a template mechanism 50, a translation mechanism 52 and an actuation mechanism 54. The template mechanism 50 provides information representative of the selected contour to which the face 18 of the grinding wheel 14 is to be dressed using the grinding wheel dresser 10. The translation mechanism 52 is coupled to the template mechanism 50, and translates the information provided by the template mechanism 50 into displacements of the dressing mechanism 26, in particular, of the tip T of the dressing element 34, along the radial and transverse axes 20 and 21 of the grinding wheel 14. The actuation mechanism 54 is coupled to the translation mechanism 52 so as to actuate the displacements of the dressing mechanism 26.

The template mechanism 50 preferably comprises a cam 56 having an outer periphery 58. The outer periphery 58 preferably has a first kick point 60A and a second kick point 60B, these points 60A and 60B substantially defining the ends of the periphery 58. The kick points 60A and 60B typically are approximately 120° apart, that portion of the cam 56 typically being used in dressing a wheel 14. The points 60A and 60B operate to separate the dressing mechanism 26 from the wheel 14, thereby halting the dressing process.

The periphery 58 of a selected cam 56 has a predetermined shape, that shape comprising the information representative of the contour selected for the face 18 of the grinding wheel 14. Although it is preferred to use cams 56 that have peripheral shapes that are in substantially 1-to-1 relationship with the selected contour, it is to be recognized that the relationship may take on other ratios or have additional or different mathematical relationships, without departing from the principles of the invention. The applicable mathematical relationship depends on various factors, including the relative geometries and dimensions of the grinding wheel dresser 10 and the grinding apparatus 12, the relationship being derivable mathematically, empirically or through a combination of both. It is also preferred that the cams 56 be selectably and readily interchangeable and that, using a single cam, the face of the grinding wheel may be dressed to a wide variety of shapes, including angular shapes, concave shapes and convex shapes, as well as combinations of one or more of these types of shapes.

The actuation mechanism 54 preferably includes a shaft 62 and a housing 90 rotatable about the shaft 62. The shaft 62 has a central axis 64, and is coupled to the integration mechanism 30 so that the central axis 64 is disposed substantially parallel to the elevational axis 22 of the grinding wheel 14 and in the plane formed by the radial and elevational axes 20 and 22. The dimensions and geometries of the grinding wheel dresser 10 are selected relative to the grinding apparatus 12 so that, upon integration of the dresser 10 with the grinding apparatus 12, the central axis 64 of the shaft 62 is substantially aligned over the portion of the face 18 to be dressed. It is also to be recognized that, subject to adjustment in alignment using the adjustment mechanism 32, the shaft 62 is coupled to the integration mechanism 30 so as to be fixed in position, particularly so as not to rotate.

The actuation mechanism 54 preferably also includes upper and lower bearing assemblies 68A and 68B. Each of the beating assemblies 68A and 68B have a sealed bearing 70 and a corresponding race 72, the race 72 being mounted in the housing 90 so as to be seated on and over the sealed bearing 70 and to rotate substantially freely about bearing 70. The sealed bearing 70 of the lower bearing assembly 68B preferably is mounted on the shaft 62 most adjacent the integration mechanism 30. The sealed bearing 70 of the upper bearing assembly 68A preferably is mounted on the shaft 62 most adjacent the end of the shaft 62 disposed opposite the integration mechanism 30.

Figure 8:
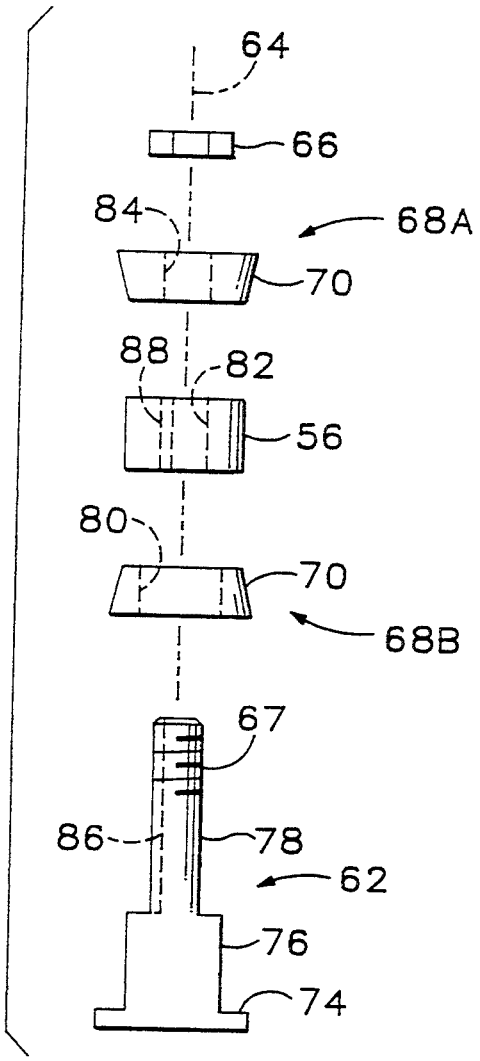
FIG. 8 is an exploded view of a shaft having sealed bearings disposed thereon, and a cam interposed between the bearings, secured by a nut tightened on a threaded end of the shaft, for use in a grinding wheel dresser in accordance with the present invention.

For template mechanisms 50 comprising cams 56, the cam 56 preferably is mounted on the shaft 62 interposed between the sealed bearings 70 of the upper and lower bearing assemblies 68A and 68B, as illustrated in FIG. 8. In that case, the shaft 62 preferably has three parts: a base 74 having the largest relative cross-sectional dimensions among the parts, the second portion 78 having the smallest relative cross-sectional dimensions, and the first portion 76 having intermediate dimensions. The sealed bearing 70 of the lower bearing assembly 68B has an aperture 80 characterized by a cross-section that corresponds in shape and dimensions to the cross-section of the first portion 76, so as to fit thereover and seat against the base 74. The cam 56 and the sealed bearing 70 of the upper bearing assembly 68A have respective apertures 82 and 84, each characterized by a cross-section that corresponds in shape and dimensions to the cross-section of the second portion 78, so as to fit thereover with the cam 56 seated against the first portion 76 and the sealed bearing 70 seated against the cam 56. Although a shaft 62 having stepped cross-sectional dimensions is shown, it is to be recognized that the shaft may have uniform cross-sectional dimensions therealong, without departing from the principles of the invention.

A nut 66 is selectably tightened on threads 67 disposed at the end of the shaft 62 opposite the integration mechanism 30, so as to secure the sealed beatings 70 and the cam 56 on the shaft 62, while adjusting the rotation of the sealed bearings 70 about corresponding races 72. Tightening the nut 66 urges the sealed bearing 70 of the upper bearing assembly 68A against the cam 56 which, in turn, urges the cam 56 against the first portion 76. Tightening the nut 66 also draws the race 72 of the upper bearing assembly 68A toward the integration mechanism 30 which, in turn, urges the sealed bearing 70 of the lower bearing assembly 68B against the base 74 of the shaft 62. This sealed bearing 70 is so urged by the race 72 of the lower bearing assembly 68B, which is itself so urged by the housing 90 which transmits the urging force equally to both races 72 mounted thereon.

As shown, the base 74, the first portion 76 and the second portion 78 of the shaft 62 have cross-sections that are substantially circular while having decreasingly stepped diameters. It is to be recognized, however, that any one or more of the base or the portions may have a non-circular cross-section without departing from the principles of the invention. For example, the cross-section of the second portion 78 may be polygonal, e.g., square, provided the aperture 82 of the cam 56 has corresponding shape and dimensions so as to fit thereover. A non-circular cross-section may be employed because, in operation, preferably neither the cam 56 nor the sealed beatings 70 rotate, provided each race 72 may rotate substantially freely about the corresponding sealed bearing 70.

Each of the sealed beatings 70 and the cam 56 preferably are removably mounted on the shaft 62. It is to be recognized, however, that the cam 56, so mounted, preferably is rotationally fixed in position, that is, rotation of the cam 56 about the central axis 64 of the shaft 62 is substantially prevented. In this way, the translation mechanism 52 may translate the information provided by the cam 56 with consistently high precision in each successive dressing of the face 18 of the grinding wheel 14. It is to be recognized that, if the cross-section of the shaft 62, in particular the cross-section of the second portion 78 thereof, is substantially circular, the second portion 78 preferably has formed therealong a key-way 86. In turn, the cam 56 has a key 88 extending into its aperture 82, the key 88 fitting precisely in the key-way 86 so as to substantially preclude rotation of the cam 56 on the second portion 78 of the shaft 62.

The housing 90 includes a longitudinal axis 92, a pivot end 94 and an operation end 96. So as to be rotatable about the shaft 62, the housing 90 has bore 98, defined by a bore wall 99, disposed in the pivot end 94, the bore 98 having a rotation axis 100. The longitudinal axis 92 of the housing 90 is disposed substantially in the plane formed by the radial and elevational axes 20 and 22 of the grinding wheel 14. The bore 98 preferably has dimensions so as to accommodate insertion therein of the shaft 62, together with the cam 56, the nut 66 and the sealed bearings 70 and races 72 of the upper and lower bearing assemblies 68A and 68B. Having the shaft 62 so inserted, the bore's rotation axis 100 preferably is coaxial with the shaft's central axis 64.

The bore 98 preferably extends through the housing's pivot end 94. In this way, the shaft 62 is accessible and provides for ready interchange of cams 56 mounted on the shaft 62 when the grinding wheel dresser 10 is integrated with the grinding apparatus 12. The bore 98 has a cap 102, providing a barrier to dirt and other contaminants which can impede the bearing assemblies' performance.

The races 72 of the upper and lower bearing assemblies 68A and 68B are mounted on the bore wall 99, disposed so as to be seated on and over the respective sealed beatings 70. The races 72 preferably have shapes and dimensions so as to preclude, in conjunction with the corresponding sealed bearings 70 as secured on the shaft 62, substantially all motion of the housing 90 other than rotational motion about the central axis 64 of the shaft 62. To do so, the respective races 72 preferably have wedge-like cross sections, as shown. It is to be recognized, however, that the races 72 may have other cross-sectional shapes without departing from the principles of the invention.

The actuation mechanism 54 includes an operating mechanism 104 for applying torque to the housing 90 so as to rotate the housing 90 about central axis 64 of the shaft 62. The operating mechanism 104 preferably comprises a handle 106 connected to the housing's end wall 108, so that a user may apply torque manually. It is to be recognized, however, that the operating mechanism 104 may be other than a handle, and torque may be applied other than manually, without departing from the principles of the invention.

The translation mechanism 52 includes a slide element 110 slidably mounted on first and second slide ways 112A and 112B. The slide ways 112A and 112B preferably are mounted to respective side walls 114A and 114B of the housing 90.

Where the template mechanism 50 comprises a cam 56, the translation mechanism 52 preferably includes a cam follower 116 coupled to the slide element 110 and to a biasing mechanism 118 that biases the cam follower 116 to engage the cam 56, particularly the cam's periphery 58, when the housing 90 is rotated about the central axis 64 of the shaft 62. The cam follower 116, as shown, comprises a substantially cylindrical projection extending from the slide element 110, and having a substantially hemispherical tip 120 that engages the cam 56. Preferably, the cam follower 116 is formed in one piece with the slide element 110. Although it is to be recognized that other materials may be used without departing from the principles of the invention, it has been found acceptable to form the slide element 110 and the cam follower 116 using leaded steel alloy type 11L17, which alloy is commonly available by that designation and from a variety of sources.

The biasing mechanism 118 includes a spring 122 connected to the slide element 110 and to the end wall 108 of the housing 90. Accordingly, the spring 122 applies a biasing force to the cam follower 116 through the slide element 110 along the longitudinal axis 92 of the housing 90 and toward the cam 56. It is to be recognized, however, that the biasing mechanism 118 may employ structure other than or in addition to the spring 122, without departing from the principles of the invention.

The slide element 110 is coupled to the dressing mechanism 26 through arm 124. The arm 124 is coupled, at one end thereof, to the slide element 110 and, at the other end thereof, to the dressing mechanism 26. To provide for that coupling, the housing 90 has an aperture 126 disposed therein toward the dressing mechanism 26, in the direction of the longitudinal axis 92. The arm 124 preferably couples at fight angles with the slide element 110 and with the dressing mechanism 26, that is, with the element mount 36 where such mount is employed. The arm 124 has a predetermined length which, as discussed further herein, is a factor in the grinding wheel dresser 10 providing substantial alignment for dressing upon integration with the grinding apparatus 12. Preferably, the arm 124 and the element mount 36 are formed as one piece so as to provide rigidity. In addition, the arm 124 and the element mount 36, as well as the housing 90, preferably are formed from aluminum alloy type 6061-T6 so as to be lightweight. It is to be recognized, however, that the arm 124 and the element mount 36 may be other than one piece, and one or more of the arm 124, the element mount 36 and the housing 90 may be formed from other materials, without departing from the principles of the invention.

When the grinding wheel dresser 10 is integrated with the grinding apparatus 12, the dressing mechanism 26, particularly the dressing element's tip T, is substantially aligned for dressing the face 18 of the grinding wheel 14. This alignment is as to each of the radial, transverse and elevational axes 20, 21 and 22 of the grinding wheel 14. In order to achieve this alignment, the dimensions and geometries of the grinding wheel apparatus 10 are selected based on a variety of factors, including the radius of the grinding wheel 14, the width of the face 18, the typical range of depths to which the face 18 is dressed in the particular application, and the amount of radial adjustability of the grinding wheel 14. For example, in dressing a grinding wheel 14 having a 12-inch diameter and a face width of half-inch, where the, grinding wheel 14 is used to sharpen the gullets and lands of an approximately 11-inch sawmill blade, typical dimensions of the grinding wheel dresser 10 in relation to the grinding apparatus 12 are approximately as follows: maximum cam diameter—$1\frac{1}{8}$ inches; overall length of cam follower 116 and slide element 110—3 inches; length of arm 124—9 and 7/1000 inches; length of dressing mechanism 26 from tip T of the dressing element 34 to the edge of the element mount 36 disposed opposite tip T—$\frac{3}{4}$ to 1 inch; distance along elevational axis 22 from tip 120 of the cam follower 116 to tip T of the dressing element 34—10 and 1/100 inches; and distance along the radial axis 20 from the center of axle 16 to the central axis 64 of the shaft 62—5 and 9/100 inches. Although these are typical relative dimensions, it is to be recognized that the grinding wheel dresser 10 has readily scalable dimensions so as to be integratable with the wide variety of grinding apparatuses, in their various applications.

The adjustment mechanism 32 comprises a transverse slide base 140 coupled to the integration mechanism 30, a transverse slide 142 slidably mounted on the transverse slide base 140, a radial slide base 144 mounted on the transverse slide 142 and a radial slide 146 slidably mounted on the radial slide base 144 and coupled to the dressing control mechanism 28. The adjustment mechanism 32 is coupled to the dressing mechanism 26 through the coupling with dressing control mechanism 28. Where the integration mechanism 30 comprises the cover 42, the transverse slide base 140 preferably is coupled directly thereto. Where the dressing control mechanism 28 comprises the shaft 62, the radial slide 146 preferably is coupled directly thereto. Although the adjustment mechanism 32, as shown, is interposed between the dressing control mechanism 28 and the integration mechanism 30, it is to be recognized that the adjustment mechanism, where employed in a grinding wheel dresser, may be otherwise disposed without departing from the principles of the invention. It is also to be recognized that the adjustment mechanism 32 may comprise additional or different structure than as described herein, without departing from the principles of the invention.

The adjustment mechanism 32 preferably also includes a transverse adjuster 148 and a radial adjuster 150, the adjusters 148 and 150 controlling motion, respectively, of the transverse and radial slides 142 and 146. Manipulation of the transverse adjuster 148 controllably slides the transverse slide 142 over the transverse slide base 140, thereby adjusting alignment of the dressing mechanism 26 substantially along the transverse axis 21 of the grinding wheel 14. Manipulation of the radial adjuster 150 controllably slides the radial slide 146 over the radial slide base 144, thereby adjusting alignment of the dressing mechanism 26 substantially along the radial axis 20 of the grinding wheel 14. Accordingly, adjusting alignment of the grinding wheel dresser 10 generally includes manipulation of the transverse and radial adjusters 148 and 150, individually or together, proper adjustment being achieved when the face 18 may be dressed to the selected contour.

As shown, each of the transverse and radial adjusters 148 and 150 comprise precisely-calibrated screw devices. Preferably, each adjuster 148 and 150 includes tactile or other sensory feedback to the user to indicate some unit amount of adjustment. It has been found acceptable, for example, to provide adjusters 148 and 150 for which each 360° of rotation corresponds to an adjustment of forty-eight thousands of an inch, and to provide tactile indications for each adjustment of two-thousands of an inch. It is to be recognized, however, that different adjustment characteristics may be used without departing from the principles of the invention.

The adjustment mechanism 32 preferably also includes a release nut 152. The release nut 152 secures the radial adjuster 150 so that the adjuster 150 is operational to control sliding of the radial slide 146, that is, so that only by manipulation of the adjuster 150 is radial adjustment effected. However, when the release nut 152 is removed, the radial adjuster 150 may be bypassed by the user, the dressing mechanism 26 and the dressing control mechanism 28 slidable along the radial axis 20 without operating the adjuster 150.

Figures 5, 6, 7:
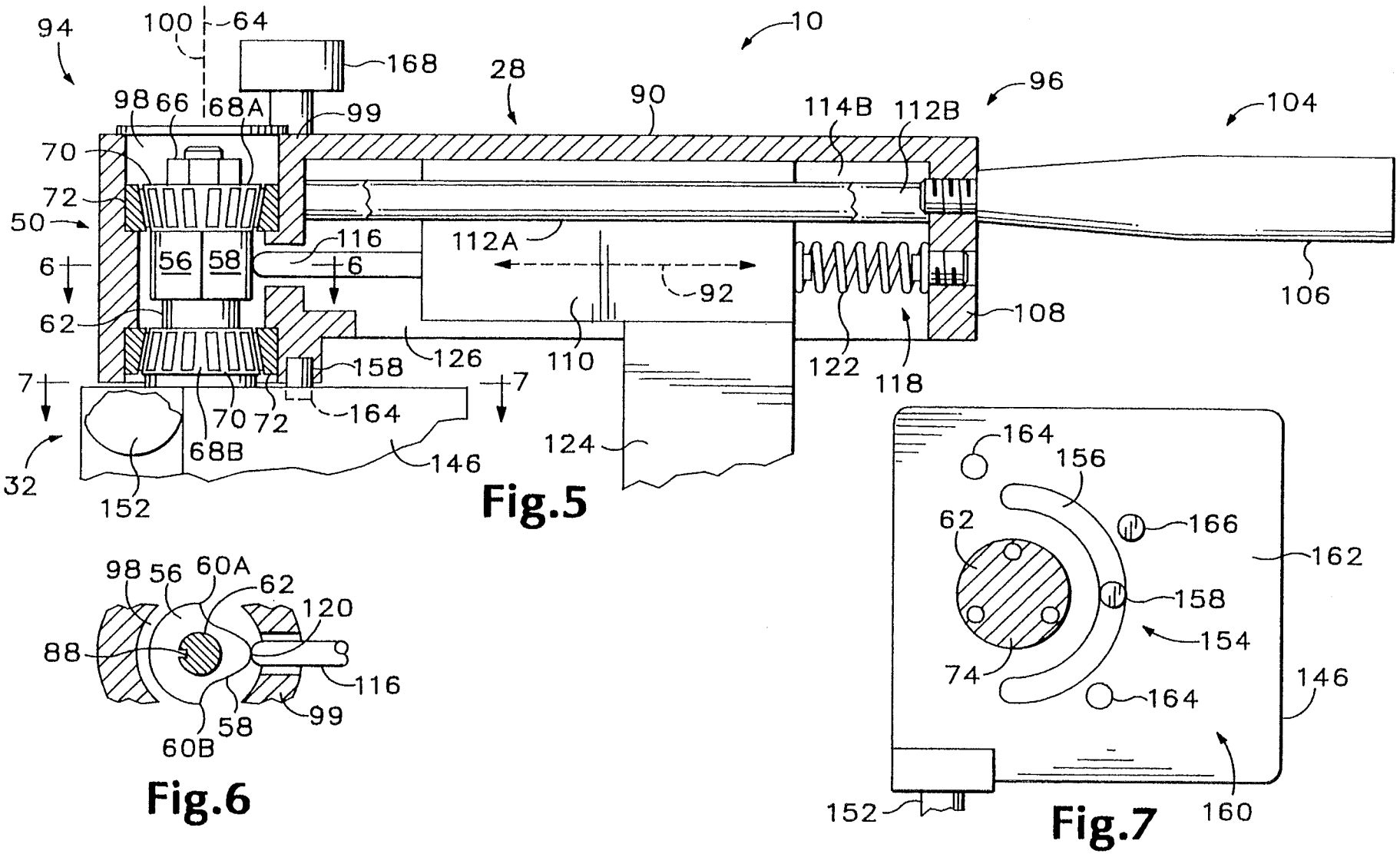
FIG. 5 is a partially cross-sectional, cut-away view of the grinding wheel dresser of FIG. 1, taken along line 5—5 thereof.
FIG. 6 is a partially cross-sectional, cut-away view of the grinding wheel dresser of FIG. 5, taken along line 6—6 thereof, showing an exemplary cam and cam follower.
FIG. 7 is a partially cross-sectional, cut-away view of the grinding wheel dresser of FIG. 5, taken along line 7—7 thereof.

The grinding wheel dresser 10 preferably includes a travel control mechanism 154 so as to control the rotational range of the housing 90 about the central axis 64 of the shaft 62 and, thereby, control the range over which the dressing mechanism 26 may dress the grinding wheel 14. Referring to FIGS. 5 and 7, the travel control mechanism 154 includes a slot 156 disposed in a base member 162, and a travel pin 158 slidably engaging the slot 156. The slot 156 preferably is arcuate, the length of the arc being selectable to determine the dress range, and has a center aligned with the central axis 64 of the shaft 62. The base member 162, as shown, is the radial slide 146 of the adjustment mechanism 32; however, it is to be recognized that the base member 162 may comprise other structure, provided it is coupled to the housing 90 so as to control the housing's rotational range, without departing from the principles of the invention. The travel pin 158 is fixedly mounted on, and extends from, the housing 90 to engage the slot 156. In operation, the housing 90 is rotatable about the central axis 64 only until the travel pin 158, sliding in the slot 156 reaches either extremity of the slot 156. Accordingly, where the template mechanism 50 employs cams 56 having kick points 60A and 60B, the travel control mechanism 154 operates in coordination with the kick points to limit the dressing of the grinding wheel 14.

The grinding wheel dresser 10 preferably also includes a positional lock mechanism 160 so as to lock the dressing mechanism 26 in a position apart from the face 18 of the grinding wheel 14. Referring to FIGS. 2, 5 and 7, the positional lock mechanism 160 includes the base member 162, one or more lock holes 164 disposed in the base member 162 and a lock pin 166 adapted to be removably inserted in the lock holes 164. The lock pin 166 is controllable by the user by manipulation of knob 168 that extends above the top of the housing 90. The lock holes 164 preferably are disposed to correspond with either extremity of the slot 156 of the travel control mechanism 154. In operation, if the housing 90 is rotated so that the lock pin 166 is inserted in either, the housing 90 is locked in that position and, thereby, the dressing mechanism 26 is locked apart from the grinding wheel 14. In those positions, the grinding wheel 14 may be used to grind, notwithstanding that the grinding wheel dresser 10 remains installed in proximate relationship thereto.

In operation, the grinding wheel dresser 10 may be used for dressing, to a selected contour, the face 18 of the grinding wheel 14 of the grinding apparatus 12. One method, useable where the dresser 10 has a cover 42, uses a housing 90 and cams 56, employs an adjustment mechanism 32 and uses a positional lock mechanism 160, comprises the following steps. At the outset, the dresser 10 is integrated with the grinding apparatus 12, for instance by removing the apparatus' original guard and attaching the dresser 10 using the cover 42. Once integrated, the user selects, and installs in the dresser 10, a cam 56 for dressing the face 18 to a particular contour; it is to be understood that that installation may require removal of a previously selected and installed cam 56. While the grinding wheel 14 is rotating on its axle 16 in the direction shown in FIGS. 1 and 2, the dressing mechanism 26 is brought into contact by properly rotating the housing 90. Dressing is performed by rotating the housing 90 about the central axis 64 of the shaft 62, that axis 64 being disposed substantially parallel to the elevational axis 22 of the grinding wheel 14. During that rotation, the cam follower 116 is biased by the biasing mechanism 118 against, and follows, the outer periphery 58 of the cam 56, generally between the first and second kick points 60A and 60B. In doing so, the slide element 110 is displaced substantially along the longitudinal axis 92 of the housing 90 which causes, by means of connecting arm 124, the dressing mechanism 26 to be correspondingly displaced, dressing the wheel 14. The method, thence, includes translating the shape of the outer periphery 58 of the selected cam 56 into displacements of the dressing mechanism 26 along the radial and transverse axes 20 and 21 of the grinding wheel 14. The translation is actuated, for example, by the user manipulating the handle 106, applying clockwise or counterclockwise torque thereon so as to rotate the housing 90.

The method may also include the step of adjusting the alignment of the dressing mechanism 26 along the radial and transverse axes 20 and 21 of the grinding wheel 14. Adjustment is accomplished by using either or both the transverse adjuster 148 and the radial adjuster 150 of the adjustment mechanism 32.

The method preferably also includes the step of locking the dressing mechanism 26 in a position apart from the face 18 of the grinding wheel 14, for instance, so as to preclude dressing the grinding wheel 14 when it is in use. More generally, by using the positional lock mechanism 160, the user may alternate between dressing the grinding wheel 14 and locking the dressing mechanism 26 apart from the wheel 14, so as to use the wheel to grind a workpiece, such as a saw blade.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A grinding wheel dresser for dressing, to a selected contour, the face of a grinding wheel of a grinding apparatus, the grinding wheel having radial and transverse axes, the grinding wheel dresser comprising:

a dressing mechanism;

a dressing control mechanism coupled to said dressing mechanism so as to both rotate and displace said dressing mechanism relative to the face of the grinding wheel, said rotation having components along the radial and transverse axes of the grinding wheel, and said displacement having components along the radial axis of the grinding wheel; and an integration mechanism, coupled to said dressing control mechanism and to the grinding apparatus, so as to integrate said grinding wheel dresser with the grinding apparatus and to form a rotational axis about which said rotation of said dressing mechanism occurs and relative to which said displacement occurs.

2. The grinding wheel dresser of claim 1, wherein said dressing mechanism comprises a dressing element and an element mount, said dressing element being adjustably mounted in said element mount.

3. The grinding wheel dresser of claim 1, wherein said dressing control mechanism comprises a template mechanism, a translation mechanism and an actuation mechanism, said template mechanism providing information representative of the selected contour to which the face of the grinding wheel is dressed, said translation mechanism translating said information of said template mechanism into displacements of the dressing mechanism along the radial and transverse axes of the grinding wheel, and said actuation mechanism coupled to said translation mechanism to actuate said displacements of said dressing mechanism as a function of the rotational position of the dressing mechanism.

4. The grinding wheel dresser of claim 3, wherein said template mechanism includes a cam having an outer periphery, said outer periphery having a predetermined shape, said shape comprising said information representative of the selected contour.

5. The grinding wheel dresser of claim 4, wherein said translation mechanism includes a cam follower and a biasing mechanism, said biasing mechanism biasing said cam follower to engage said cam so as to follow said outer periphery of said cam.

6. The grinding wheel dresser of claim 5, wherein said actuation mechanism includes a housing and said translation mechanism includes a slide element, said housing having a longitudinal axis disposed substantially parallel to the radial axis of said grinding wheel, said slide element mounted to slide along said longitudinal axis and coupled to said cam follower and to said dressing mechanism so that, as said cam follower follows said outer periphery of said cam, said slide element is displaced along said longitudinal axis, said displacement of said slide element causing said displacement of said dressing mechanism.

7. The grinding wheel dresser of claim 6, further comprising a shaft, said shaft being nonrotatably coupled to said integration mechanism and having a central axis forming said rotational axis, and said housing being mounted so as to rotate about said central axis of said shaft.

8. The grinding wheel dresser of claim 3, wherein said actuation mechanism includes a housing and a shaft, said shaft being nonrotatably coupled to said integration mechanism and having a central axis forming said rotational axis, and said housing being mounted so as to rotate about said central axis of said shaft.

9. The grinding wheel dresser of claim 8, wherein said actuation mechanism includes an operating mechanism for applying torque to said housing.

10. The grinding wheel dresser of claim 9, wherein said operating mechanism includes a handle attached to said housing, said handle for manual application of torque to said housing.

11. The grinding wheel dresser of claim 8, further comprising a travel control mechanism to control the range over which said dressing mechanism may dress the grinding wheel.

12. The grinding wheel dresser of claim 1, wherein the grinding apparatus has a frame, and said integration mechanism includes an integration member coupled to the frame of the grinding apparatus.

13. The grinding wheel dresser of claim 12, wherein said integration member comprises a cover, said cover being attached to the frame of the grinding apparatus so as to fit over the grinding wheel, placing said dressing mechanism proximate the face of the grinding wheel.

14. The grinding wheel dresser of claim 13, further comprising a positional lock mechanism so as to selectably alternate between locking said dressing mechanism in a position apart from the face of the grinding wheel in order to use the grinding apparatus, and unlocking said dressing mechanism for rotation in order to dress the grinding wheel.

15. The grinding wheel dresser of claim 1, further comprising an adjustment mechanism, coupled to said dressing mechanism, to adjust the alignment of said dressing mechanism along the radial and transverse axes relative to the face of the grinding wheel.

16. The grinding wheel dresser of claim 1, wherein the dimensions and geometries of said dressing mechanism, said dressing control mechanism and said integration mechanism are selected, relative to the dimensions and geometries of the grinding apparatus, to provide substantial alignment of the dressing mechanism to the face of the grinding wheel upon integration of the grinding wheel dresser and the grinding apparatus.

17. The grinding wheel dresser of claim 1, further comprising a shaft, said shaft being nonrotatably coupled to said integration mechanism and having a central axis, said central axis forming said rotational axis.

18. The grinding wheel dresser of claim 17, wherein said dressing control mechanism includes a housing and a cam, said housing being mounted to said shaft so as to rotate about said central axis of said shaft, said cam being nonrotatably mounted over said shaft and having an outer periphery of a predetermined shape, said shape representing said displacement of said dressing mechanism as a function of the rotational position of the dressing mechanism.

19. A method for dressing, to a selected contour, the face of a grinding wheel of a grinding apparatus, the grinding wheel having radial and transverse axes, the method comprising the steps of:

integrating the grinding apparatus and a grinding wheel dresser so that said grinding wheel dresser has an associated rotational axis;

rotating a portion of said grinding wheel dresser about said rotational axis, so as to rotate a dressing mechanism, said rotation having components along the radial and transverse axes of the grinding wheel; and actuating displacement of said dressing mechanism, the displacement having components along the radial axis of the grinding wheel, the magnitude of displacement corresponding to the rotational position of the dressing mechanism relative to the face of the grinding wheel.

20. The method of claim 19, further comprising the step of translating the shape of the outer periphery of a cam in actuating said displacement of the dressing mechanism, the shape being representative of the selected contour to which the face of the grinding wheel is dressed.

21. The method of claim 19, further comprising adjusting the alignment of said dressing mechanism of said grinding wheel dresser along the radial and transverse axes of the grinding wheel, so as to selectably align the dressing mechanism relative to the face of the grinding wheel.

22. The method of claim 19, further comprising locking the dressing mechanism in a position apart from the face of the grinding wheel, so as to preclude dressing the grinding wheel while providing for using the grinding wheel.

23. The method of claim 22, further comprising alternating between dressing the face of the grinding wheel and locking the dressing mechanism apart from the grinding wheel so as to use the dressed grinding wheel.

24. The grinding wheel dresser of claim 19, further comprising the step of employing a shaft, said shaft being nonrotatably coupled to said grinding apparatus and having a central axis, said central axis forming said rotational axis.

25. The grinding wheel dresser of claim 24, further comprising the step of employing a cam and a housing, said housing being mounted to said shaft so as to rotate about said central axis of said shaft, said cam being nonrotatably disposed over said shaft and having an outer periphery of a predetermined shape, said shape representing said displacement of said dressing mechanism as a function of the rotational position of the dressing mechanism.

* * * * *